US012753625B1

(12) United States Patent
Gaber

(10) Patent No.: US 12,753,625 B1
(45) Date of Patent: Oct. 6, 2026

(54) POPUP TENT WITH ACCESSORY SHELF

(71) Applicant: Travis G. Gaber, McKinney, TX (US)

(72) Inventor: Travis G. Gaber, McKinney, TX (US)

( * ) Notice: Subject to any disclaimer, the term of this patent is extended or adjusted under 35 U.S.C. 154(b) by 363 days.

(21) Appl. No.: 18/602,276

(22) Filed: Mar. 12, 2024

Related U.S. Application Data

(60) Provisional application No. 63/451,745, filed on Mar. 13, 2023.

(51) Int. Cl.

| | |
|---|---|
| ***E04H 15/02*** | (2006.01) |
| ***E04H 15/32*** | (2006.01) |
| *A47B 43/04* | (2006.01) |
| *A47B 47/00* | (2006.01) |
| *E04H 15/50* | (2006.01) |

(52) U.S. Cl.
CPC ..... *E04H 15/02* (2013.01); *E04H 15/32* (2013.01); *A47B 43/04* (2013.01); *A47B 47/0083* (2013.01); *E04H 15/50* (2013.01)

(58) Field of Classification Search
CPC ..... E04H 15/02; E04H 15/32; E04H 15/50; A47B 47/0083; A47B 43/04
USPC ..... 135/120.1, 96; 108/42, 50.11; 312/3–5
See application file for complete search history.

(56) References Cited

U.S. PATENT DOCUMENTS

| | | | | |
|---|---|---|---|---|
| 1,941,652 | A * | 1/1934 | Bellavia | A45F 4/00 297/183.1 |
| 2,836,860 | A * | 6/1958 | Staropoli | E04H 1/1222 52/36.2 |
| RE33,232 | E * | 6/1990 | Fausett | A47B 47/0008 211/87.01 |
| 6,276,383 | B1 * | 8/2001 | Galstad | E04H 15/58 135/90 |
| 10,125,516 | B2 * | 11/2018 | Stehly | E04H 1/1272 |
| 11,214,954 | B2 * | 1/2022 | Styrc | E04B 1/2608 |
| 11,399,637 | B1 * | 8/2022 | Spencer | A47D 9/00 |
| 11,459,789 | B2 * | 10/2022 | Thomas | E04H 15/58 |
| 11,692,369 | B2 * | 7/2023 | Tao | E04H 15/50 135/139 |
| 2015/0211252 | A1 * | 7/2015 | Park | E04H 15/58 135/96 |
| 2015/0308143 | A1 * | 10/2015 | Levin | E04H 15/36 135/121 |
| 2019/0284831 | A1 * | 9/2019 | Volin | E04H 15/58 |
| 2021/0054646 | A1 * | 2/2021 | Volin | A47B 85/06 |
| 2022/0251869 | A1 * | 8/2022 | Thomas | E04H 15/58 |
| 2022/0412119 | A1 * | 12/2022 | Tao | E04H 15/50 |
| 2025/0034901 | A1 * | 1/2025 | McCauley | E04H 15/02 |

* cited by examiner

*Primary Examiner* — Robert Canfield
(74) *Attorney, Agent, or Firm* — Kenneth L. Tolar

(57) ABSTRACT

A popup tent includes an accompanying storage shelf constructed with an elastomeric mesh that is attachable to the canopy support frame. The shelf is secured immediately below the canopy to provide an elevated, peripheral storage shelf for personal items.

7 Claims, 4 Drawing Sheets

POPUP TENT WITH ACCESSORY SHELF

CROSS REFERENCE TO RELATED APPLICATIONS

This application claims priority of provisional application No. 63/451,745 filed on Mar. 13, 2023, the specification of which is incorporated herein by reference.

BACKGROUND OF THE INVENTION

Disclosed herein is a popup tent having an attachable shelf for storing personal items.

DESCRIPTION OF THE PRIOR ART

A popup tent is a specialized structure including a canopy suspended atop a support frame that provides temporary shelter at various outdoor venues, such as the beach, sporting events or campsites. While engaging in certain outdoor activities, participants must often remove and stow cell phones, wallets, purses, electronic devices, and other valuables. However, since it is primarily intended to shield users from sunlight, a popup tent typically includes only an overhead canopy with no sidewalls, bottom wall, or storage space whatsoever. Accordingly, the canopy interior is readily exposed to environmental elements, including strangers and animals. As a result, the participants must often place valuable personal items on nearby or underlying grass, soil, or sand where they are easily lost, stolen, misplaced, or damaged by debris or moisture.

Accordingly, there is currently a need for a popup tent that can securely store and conceal personal items. The present invention addresses this need by providing a popup tent having a peripheral storage shelf that is positioned beneath the canopy.

SUMMARY OF THE INVENTION

A popup tent includes an accompanying storage shelf constructed with an elastomeric mesh that is attachable to the canopy support frame. Accordingly, the shelf is secured immediately below the canopy to provide an elevated, peripheral storage shelf for personal items.

It is therefore an object of the disclosed device to provide a popup tent having an attachable shelf for storing personal items.

It is therefore another object of the disclosed device to provide a popup tent that eliminates the undesirable practice of storing personal items on grass or soil when participating in outdoor events.

It is therefore yet another object of the disclosed device to provide a popup tent having an attachable storage shelf that expands to easily fasten to the tent's support frame.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
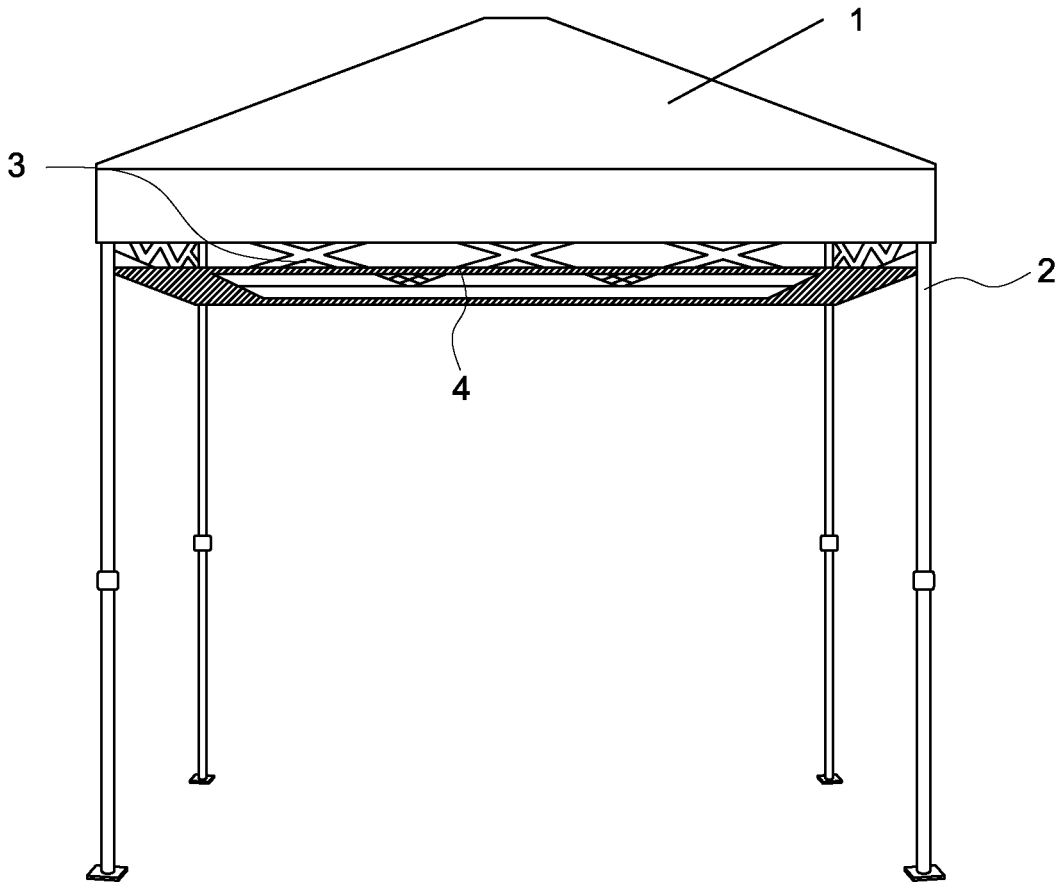
FIG. 1 is a perspective view of the popup tent according to the present disclosure fully erected with the storage shelf installed.

A popup tent having an accessory shelf includes a canopy 1 that is suspended by a base frame formed of a plurality of length-adjustable support legs 2 depending from a collapsible roof support structure. Expandable, scissor-frame side rails 3 beneath the roof support structure extend between the legs to allow the entire base frame to be collapsed inwardly for storage or expanded when in use.

The popup tent also includes an accompanying storage shelf including a continuous fabric band 4 having one or more peripheral outer edges 41 and one or more peripheral inner edges 51 parallel to the outer edges. The inner peripheral edges 51 define a large central opening 5 having a surface area that is slightly less than the surface area of the space covered by the expanded canopy. The band 4 has substantially the same geometrical outline and marginal dimension as the interior periphery of the canopy when both are expanded and erected.

Figure 2:
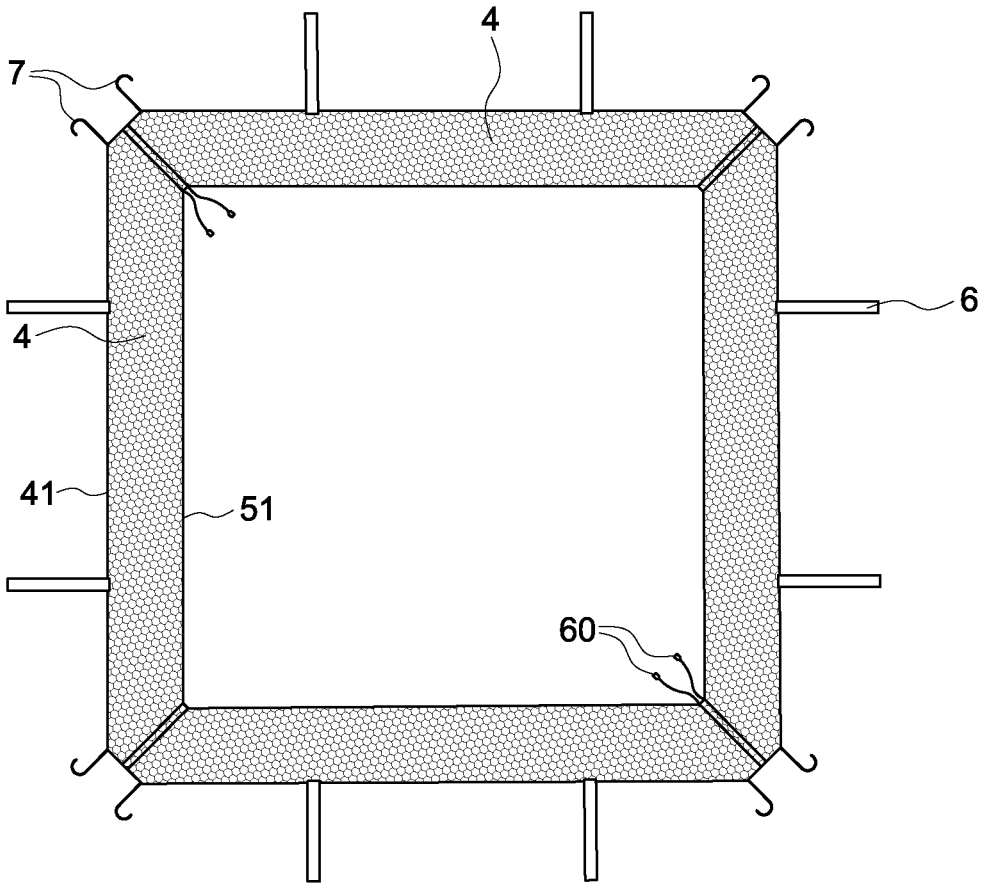
FIG. 2 is a top plan view of the storage shelf.
Figure 3:
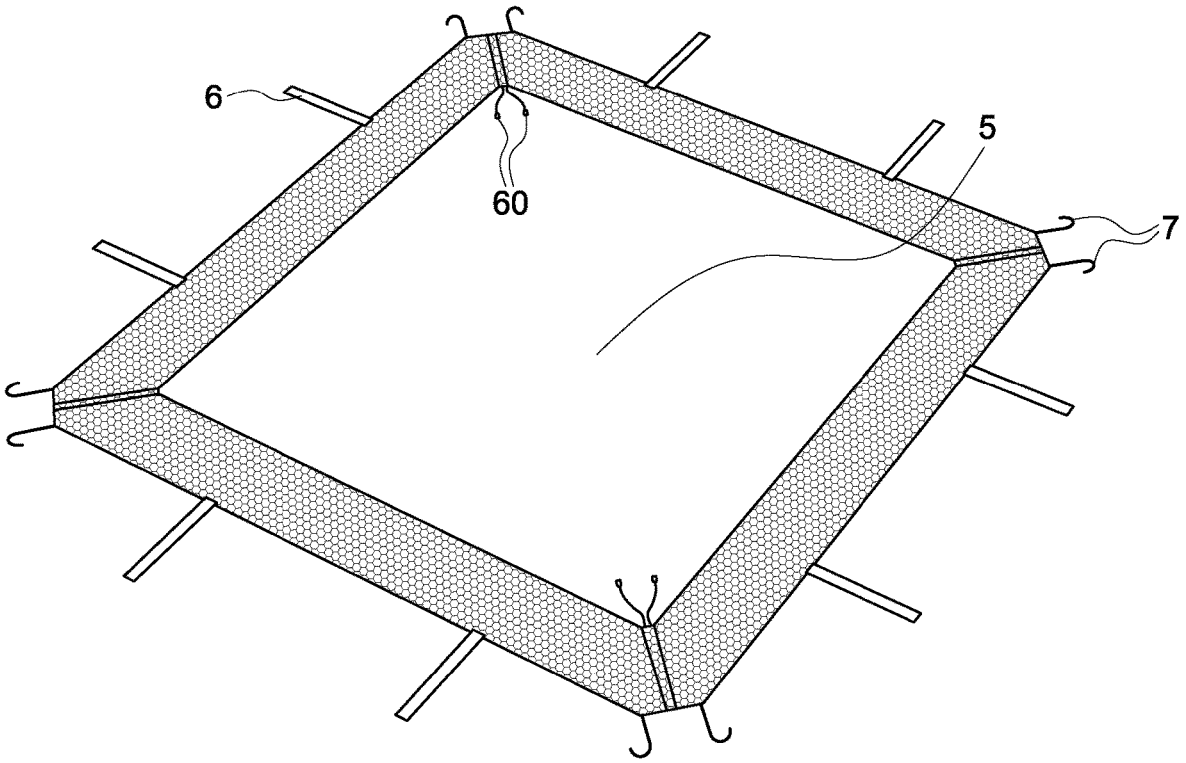
FIG. 3 is a perspective view of the storage shelf.
Figure 4:
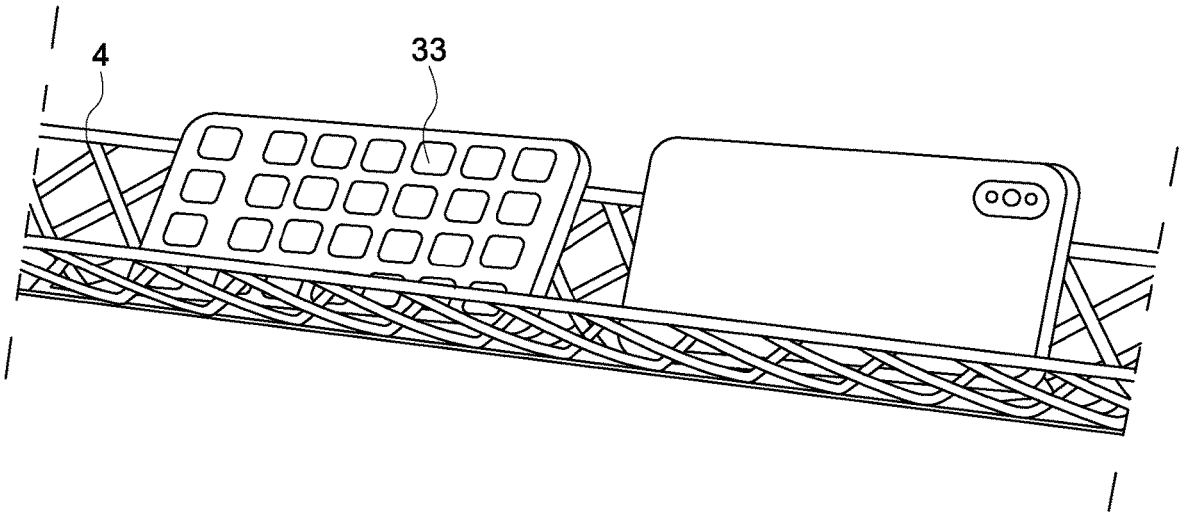
FIG. 4 is a sectional view of the storage shelf with personal items positioned thereon.

Although the band is depicted in FIGS. 1-4 as rectangular or square, it could also be circular, triangular, ovate or any other shape that corresponds to and traces the general outline of the canopy. The band 4 is preferably constructed with an elastomeric, hydrophilic, nylon mesh that easily expands and contracts without damaging the structural integrity of the fabric. Furthermore, the nylon mesh absorbs moisture to prevent water damage to any items stored on the shelf.

On each outer peripheral edge 41 of the band are multiple sets of hooks 7 for gripping the frame support legs 2. Each set of hooks 7 is diametrically positioned relative to another set of hooks to stretch the band outwardly to grip all frame support legs while forming a rigid shelf. Releasable straps 6 with mating fasteners are positioned between adjacent sets of hooks 7 for further attaching the band to the base frame side rails 3 to prevent the portion of the shelf between the hooks from sagging. The inner peripheral edges 51 of the band include an integral drawstring 60 that enhances the structural integrity of the shelf to support heavier personal items, such as wireless phones 33 or other electronic devices.

Accordingly, the fabric band 4 is secured to the support frame immediately below the canopy to provide an elevated, sheltered shelf for storing personal items 33. The large central opening 5 prevents the shelf from obstructing users positioned beneath the canopy.

The above-described device is not limited to the exact details of construction and enumeration of parts provided herein. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A popup tent comprising:

a base frame formed of a plurality of length-adjustable support legs interconnected with expandable side rails;

a canopy suspended atop said base frame;

a continuous fabric band having at least one peripheral outer edge and at least one peripheral inner edge parallel to the peripheral outer edge, said inner peripheral edge defining a central opening;

means for attaching said continuous fabric band to said base frame to form an elevated, peripheral storage shelf, whereby the fabric band is secured to the support frame immediately below the canopy to provide an elevated, sheltered shelf for storing personal items while said central opening prevents the shelf from obstructing users positioned beneath the canopy.

2. The popup tent according to claim 1 wherein said band has substantially a same geometrical outline and marginal dimension as an interior periphery of the canopy when both are expanded and erected.

3. The popup tent according to claim 1 wherein said means for attaching said continuous fabric band to said base frame to form an elevated peripheral storage shelf comprises multiple sets of hooks on the outer peripheral edge of the band, said multiple sets of hooks gripping the length-adjustable support legs.

4. The popup tent according to claim 3 wherein said means for attaching said continuous fabric band to said base frame to form an elevated peripheral storage shelf further comprises releasable straps with mating fasteners positioned between the multiple sets of hooks, said releasable straps attached to said expandible side rails.

5. The popup tent according to claim 3 wherein each of said sets of hooks is diametrically positioned relative to another of said sets of hooks to stretch the band outwardly to grip all said length-adjustable support legs while forming a rigid shelf.

6. The popup tent according to claim 1 wherein the inner peripheral edge of said band includes an integral drawstring for enhancing the structural integrity of the shelf.

7. The popup tent according to claim 1 wherein said band is constructed with an elastomeric, hydrophilic, nylon mesh that easily expands and contracts without structurally damaging said band.

* * * * *